US006887074B1

(12) United States Patent
Hsiao et al.

(10) Patent No.: US 6,887,074 B1
(45) Date of Patent: May 3, 2005

(54) CONTINUOUS PRODUCTION VACUUM SINTERING APPARATUS AND VACUUM SINTERING SYSTEM ADOPTED TO THE SAME

(75) Inventors: Chun-Yen Hsiao, Taipei (TW); Yu-An Li, Taipei (TW); Jin-Lung Tsai, Taipei (TW); Kuei-Wen Cheng, Taipei (TW)

(73) Assignee: Teco Nanotech Co., Ltd., Taipei (TW)

( * ) Notice: Subject to any disclaimer, the term of this patent is extended or adjusted under 35 U.S.C. 154(b) by 3 days.

(21) Appl. No.: 10/855,338

(22) Filed: May 28, 2004

(51) Int. Cl.[7] ..... F27B 9/04
(52) U.S. Cl. ..... 432/129; 432/128; 432/171
(58) Field of Search ..... 432/128, 129, 432/13, 9, 121, 164, 171

(56) References Cited

U.S. PATENT DOCUMENTS 3,708,157 A * 1/1973 Aubry et al. ..... 432/66
4,518,353 A * 5/1985 Banno et al. ..... 432/205
4,627,814 A * 12/1986 Hattori et al. ..... 432/128
5,350,295 A * 9/1994 Kenji ..... 432/5
6,530,780 B2 * 3/2003 Mori et al. ..... 432/121
6,629,838 B1 * 10/2003 Van Vuuren et al. ..... 432/148

* cited by examiner

*Primary Examiner*—Gregory Wilson
(74) *Attorney, Agent, or Firm*—Troxell Law Office PLLC

(57) ABSTRACT

A continuous production vacuum sintering apparatus has a conveyer unit and a plurality of vacuum sintering systems individually transferred by the conveyer unit. Each of the vacuum sintering systems includes a sintering furnace, a vacuum control unit communicating with the sintering furnace via an exhaustion valve, a temperature control unit electrically connecting the sintering furnace, and a partition disposed in the sintering furnace and adjacent to the exhaustion valve. The vacuum sintering systems correspond to respective sintering steps, each of which continues from a previous one with a predetermined period. The vacuum sintering systems are separate from one another. The respective pressure and temperature conditions provided by the corresponding vacuum sintering systems do not interfere with one another.

26 Claims, 2 Drawing Sheets

CONTINUOUS PRODUCTION VACUUM SINTERING APPARATUS AND VACUUM SINTERING SYSTEM ADOPTED TO THE SAME

BACKGROUND OF THE INVENTION

1. Field of the Invention

The present invention relates to a vacuum sintering apparatus, and particularly relates to a continuous production vacuum sintering apparatus and a vacuum sintering system adopted to the same.

2. Background of the Invention

There are several categories of a flat panel display (FPD), such as, for example a field emission display (FED), a thin film transistor-liquid crystal display (TFT-LCD), a plasma display panel (PDP), an organic electro-luminescence display (OELD), or a reflection-type liquid crystal display (LCD). Thinness, lightness, low power consumption, and portability are the common features among the FPDs mentioned above. The so-called FED has many similarities with conventional cathode ray tubes (CRT). As for the CRT, electrons are accelerated in a vacuum towards phosphors, which then glows. The main difference from the CRT is that the electrons are generated by field emission rather than thermal emission, so the device consumes much less power and can be turned on instantly. Instead of one single electron gun, each pixel includes several thousands of sub-micrometer or even nanometer tips from which electrons are emitted. The tips, made of low work-function materials, in particular of carbon nanotubes (CNTs) nowadays, are sharp, so that the local field strengths become high enough for even a moderately low gate voltage.

In a conventional CNT-FED, specific metallic material, as a cathode, such as, for example, silver, aluminum, copper or indium tin oxide, can melt at a low temperature in a low pressure or vacuum environment. A solvent with high volatility and thousands of CNTs arranged therein is patterned on the cathode. After a vacuum or low-pressure sintering process, the CNTs will be merged in the melted cathode. However, because the cathode is heated in a thermal radiation manner, the heating and sinking durations thereof are so long that the manufacturing efficiency thereof cannot increase. Since an exhaustion valve is provided to be adjacent to the conventional CNT-FED so close that an evaporation rate of the solvent will rise, this results in a low, rare adhesion density of the CNTs and a low conductivity of the conventional CNT-FED thereby.

In addition, the conventional CNT-FED now is manufactured like one-off production products due to the individual sintering system and accuracy conditions. The conventional CNT-FED is manufactured depending on either the customers' needs or the conditions' precisions to make an individual item. Each single conventional CNT-FED is processed once every time in a furnace, in a process usually suited for a pilot run. If an order for multiple conventional CNT-FEDs is received, several furnaces will individually fail with regard to quality management and suffer low manufacturing efficiency, resulting in high costs.

Hence, an improvement over the prior art is required to overcome the disadvantages thereof.

SUMMARY OF INVENTION

The primary object of the invention is therefore to specify a continuous production vacuum sintering apparatus and a vacuum sintering system adopted to the same. A plurality of vacuum sintering systems with different sintering conditions is arranged on a conveyer unit as a continuous flow process for monitoring sintering quality, production tempo, and manufacturing quantity. Each vacuum sintering system is capable of functioning with both heat conduction and heat radiation with a gradual rate so as to prolong the service life thereof, and to increase heat efficiency and manufacturing efficiency. In addition, the vacuum sintering system prevents rare adhesion density of the CNTs from air disturbance due to an air exhaustion process. The vacuum sintering system is also characteristic of convenient inspection for effectively monitoring product state.

According to the invention, the object is achieved by a continuous production vacuum sintering apparatus and a vacuum sintering system adopted to the same. The continuous production vacuum sintering apparatus includes a conveyer unit and a plurality of vacuum sintering systems transferred individually by the conveyer unit. Each of the vacuum sintering systems adopted for an electron emission source includes a sintering furnace, a vacuum control unit communicating the sintering furnace via an exhaustion valve, a temperature control unit electrically connecting the sintering furnace, a partition disposed in the sintering furnace and adjacent to the exhaustion valve, and a vacuum valve arranged in the sintering furnace and supplying air to break the vacuum. The temperature control unit includes an infrared radiation ceramic heater and a ceramic plate arranged above the infrared radiation ceramic heater; the ceramic plate is capable of spreading and transmitting heat from the infrared radiation ceramic heater, the electron emission source has a glass substrate contacting the ceramic plate, and the temperature control unit has a varying temperature with a predetermined rate. The respective vacuum sintering systems correspond to a plurality of sintering steps, each of which continues from a previous one with a predetermined period; the vacuum sintering systems are individual from one another. The respective pressure and temperature conditions provided by the corresponding vacuum sintering systems do not interfere with one another.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
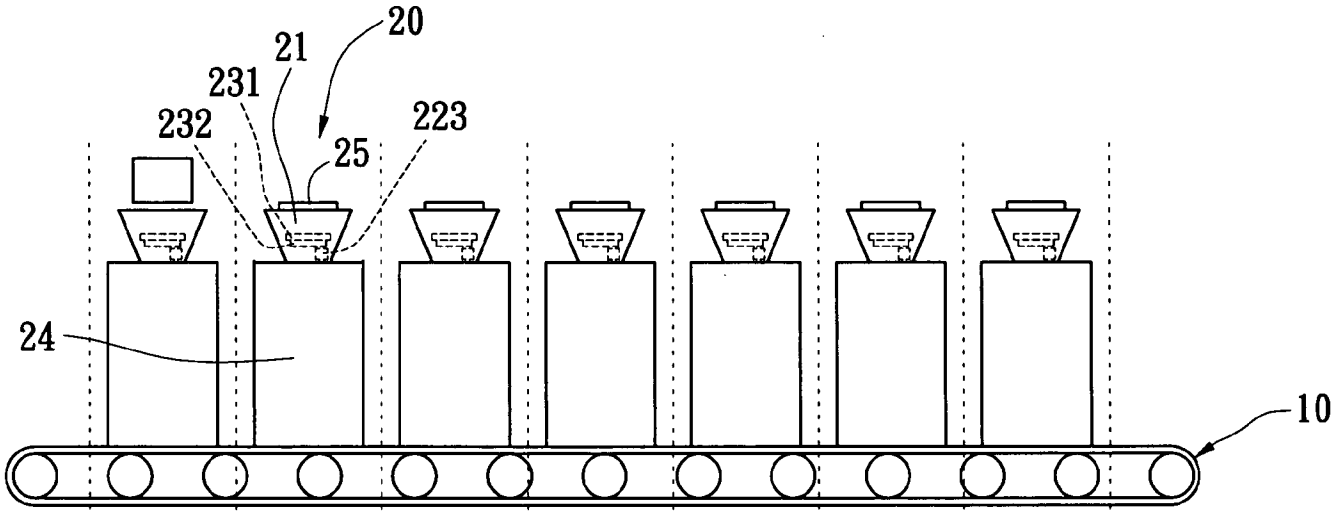
FIG. 1 is a perspective view of a continuous production vacuum sintering apparatus according to the present invention.
Figure 2:
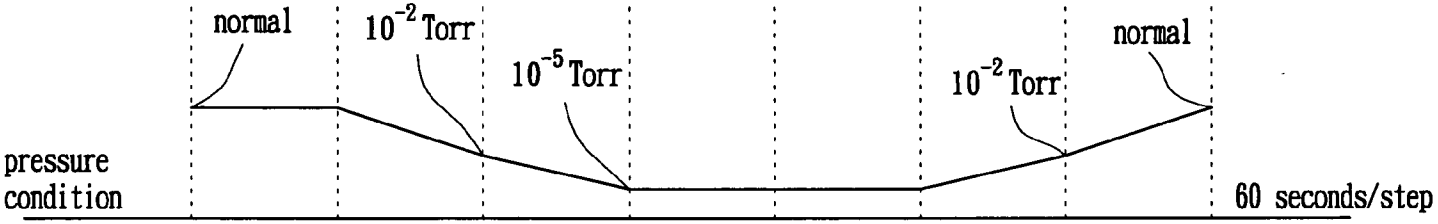
FIG. 2 is a pressure chart of the continuous production vacuum sintering apparatus according to the present invention.
Figure 3:
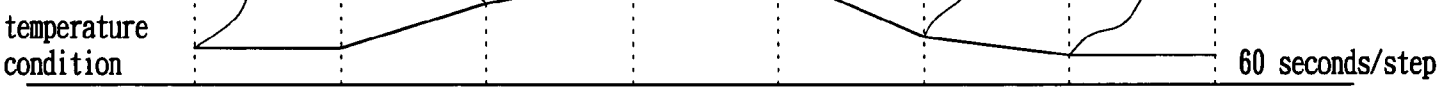
FIG. 3 is a temperature chart of the continuous production vacuum sintering apparatus according to the present invention.
Figure 5:
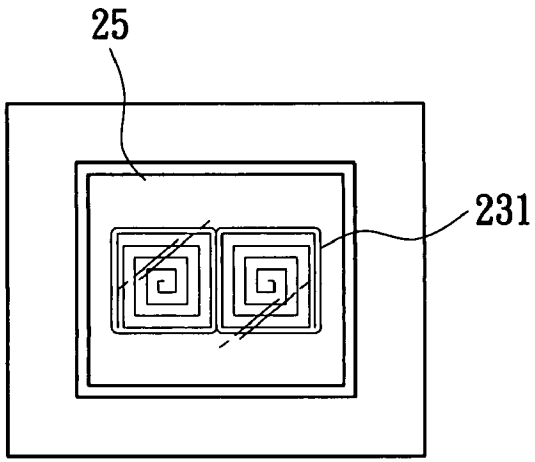
FIG. 5 is an enlarged view of the vacuum sintering system according to the present invention.
Figure 4:
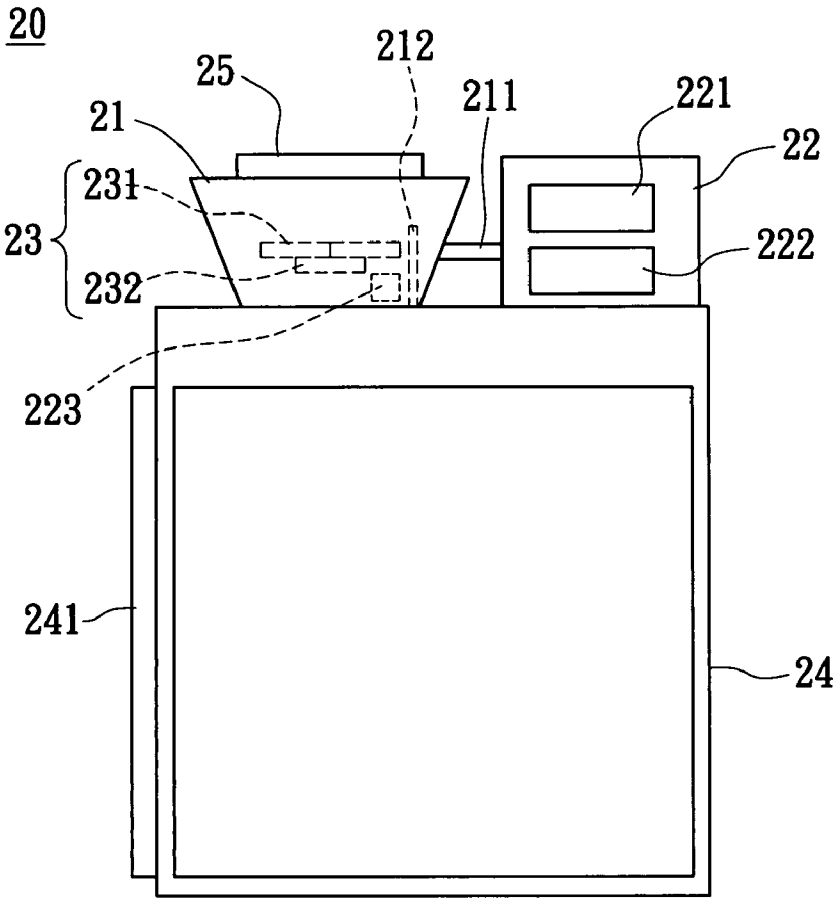
FIG. 4 is a side view of a vacuum sintering system according to the present invention.

With respect to FIGS. 1 to 3, the present invention provides a continuous production vacuum sintering apparatus, which includes a conveyer unit 10 and a plurality of vacuum sintering systems 20 individually transferred one by one by the conveyer unit 10. With respect to FIGS. 4 and 5, each of the vacuum sintering systems 20 adopted for an electron emission source includes a sintering furnace 21, a vacuum control unit 22 communicating with the sintering furnace 21 via an exhaustion valve 211, a temperature control unit 23 electrically connecting the sintering furnace 21, and a partition 212 disposed in the sintering furnace 21 and adjacent to the exhaustion valve 211. The temperature control unit 23 includes an infrared radiation ceramic heater 232 and a ceramic plate 231 arranged above the infrared radiation ceramic heater 232. The ceramic plate 231 is capable of spreading and transmitting heat from the infrared radiation ceramic heater 232. The electron emission source (not shown) has a glass substrate (not shown) contacting the ceramic plate 231, so as to increase the heating and sinking rates effectively. The temperature control unit 23 has a varying temperature with a predetermined rate. The respective vacuum sintering systems 20 correspond to a plurality of sintering steps. Each of the vacuum sintering systems 20 shows a temperature series and a pressure series by the sintering steps, each of which continues from a previous one with a predetermined period. The vacuum sintering systems 20 are separate from one another. The respective pressure and temperature conditions provided by the corresponding vacuum sintering systems 20 do not interfere with one another. The vacuum sintering systems 20 with different sintering conditions are arranged individually on the conveyer unit 10 one by one as a continuous flow process for monitoring sintering quality, production tempo, and manufacture quantity thereby. The predetermined period is about 60 seconds, and the predetermined rate approaches 10 degrees centigrade per second.

The quantity of the vacuum sintering systems 20 is at least 7. The 7 vacuum sintering systems 20 are combined to demonstrate a temperature cycle and a pressure cycle. The vacuum control unit 22 includes a diffusion pump 221, an oil pump 222 and a vacuum valve 223 arranged in the sintering furnace 21 for supplying air to break the vacuum.

The sintering steps in the respective vacuum sintering systems 20 include original conditions approaching normal pressure and normal temperature. A first state has a pressure condition ranging from a normal pressure to a first pressure approaching $10^{-2}$ Torr via the oil pump 222, and a temperature condition ranging from a normal temperature to a first temperature approaching 350 degrees centigrade. A second state has a pressure condition ranging from a first pressure approaching $10^{-2}$ Torr to a second pressure approaching $10^{-5}$ Torr via the diffusion pump 221, and a temperature condition ranging from a first temperature approaching 350 degrees centigrade to a second temperature approaching 380 degrees centigrade. A third state has a pressure condition of a second pressure approaching $10^{-5}$ Torr and a temperature condition of a second temperature approaching 380 degrees centigrade. A fourth state has a pressure condition of a second pressure approaching $10^{-5}$ Torr, and a temperature condition ranging from a second temperature approaching 380 degrees centigrade to a third temperature approaching 50 degrees centigrade. A fifth state has a pressure condition ranging from a second pressure approaching $10^{-5}$ Torr to a third pressure approaching $10^{-2}$ Torr via the diffusion pump 221, and a temperature condition ranging from a third temperature approaching 50 degrees centigrade to a normal temperature. And finally a sixth state has a pressure condition ranging from a second pressure approaching $10^{-2}$ Torr to approach to a normal pressure via the oil pump 222, and a temperature condition ranging from a third temperature approaching 50 degrees centigrade to a normal temperature, in which the normal pressure is provided after the vacuum valve 223 is switched on. The sintering steps can be performed repeatedly in the respective vacuum sintering systems 20. Simultaneously, the 7 vacuum sintering systems 20 can be taken as a big, continuous flow system, which is of the temperature and pressure cycles. Thus, the continuous production vacuum sintering apparatus can handle a rate of manufacturing progress, control the production mass, and manage the production line conveniently, so as to raise the manufacturing efficiency.

The vacuum sintering system 20 is applicable with the electron emission source in an FED and further includes a trolley 24 above which the sintering furnace 21 is arranged, and a glass coverplate 25 enclosing the sintering furnace 21 so as to form a closed cavity in the sintering furnace 21. The vacuum control unit 22 is disposed on the trolley 24. The glass coverplate 25 is transparent for visual inspection in order to monitor the production state. The oil pump 222 provides a pressure condition approaching $10^{-2}$ Torr, and the diffusion pump 221 provides a pressure condition approaching $10^{-5}$ Torr. The partition 212 is disposed to barricade the air disturbance due to an air exhaustion process via the exhaustion valve 211; thus an evaporation rate of the solvent will decrease and the adhesion density of the CNTs will increase. A conductivity of the conventional CNT-FED will increase thereby. The vacuum valve 223 of each vacuum sintering system 20 is capable of breaking the valve to open the glassplate 25 easily, and functions with both heat conduction and heat radiation with a gradual rate, so as to prolong the service life thereof, and to increase heat efficiency and manufacture efficiency. The vacuum valve 223 communicates with an air supply, which provides air and does not interfere with the electron emission source. The air may include nitrogen or inert gases. The vacuum valve 223 can further connect a central control unit (not shown) for breaking the vacuum.

The vacuum sintering system 20 first provides the first pressure approaching $10^{-2}$ Torr via the oil pump 222 from the normal pressure in the sintering furnace 21; after maintaining this pressure for about 1 minute, the second pressure approaching $10^{-5}$ Torr is provided via the diffusion pump 221 from the first pressure approaching $10^{-2}$ Torr. In the meantime, the infrared radiation ceramic heater 232 warms up the ceramic plate 231 at a rate of 10 degrees centigrade per second to avoid damaging, cracking or breaking the glass substrate of the electron emission source, as would occur from sudden heating. For the ceramic plate 231 providing the thermal conduction, the heating process in the sintering furnace 21 runs with a high heating efficiency, and the FED is manufactured with a high production efficiency thereby. The ceramic plate 231 is warmed up to a highest temperature ranging from 370 to 390 degrees centigrade (a preferred maximum temperature approaches 380 degrees centigrade), and the temperature is maintained for 1 to 2 minutes, so that the CNTs in the FED will merge sufficiently into the melted cathode. Then, the infrared radiation ceramic heater 232 stops heating process to switch to the oil pump 222 from the diffusion pump 221; thus the third pressure approaching $10^{-2}$ Torr is provided via the oil pump 222 from the second pressure approaching $10^{-5}$ Torr. The oil pump 222 is switched off to decrease the third pressure almost to the normal pressure; the normal pressure is provided after the vacuum valve 223 switches on. The air supply provided with nitrogen or inert gases is harmless to the electron emission source in the FED, and can adjust the temperature condition in the sintering furnace 21 back to the normal temperature simultaneously. The central control unit of each vacuum sintering system 20 is used to control the vacuum control unit 22 and the temperature control unit 23, and a control panel 241 disposed outside the trolley 24 and electrically connecting to the central control unit for the user.

Furthermore, the continuous production vacuum sintering apparatus can include a plurality of monitoring modules (not shown) corresponding to the respective vacuum sintering systems 20, as well as an emergency power interruption unit (not shown). Each of the monitoring modules can issue an alarm when one of the respective vacuum sintering systems 20 shows an unusual status or is unstable, or the conveyer unit 10 is not moving smoothly. The emergency power interruption unit is capable of shutting down the power when any unusual status is detected by each of the monitoring modules, a problem can therefore be resolved in a timely manner. The monitoring modules communicate with the respective vacuum sintering systems 20 and the conveyer unit 10 in a remote manner; alternatively, the monitoring modules electrically and mechanically connect the respective vacuum sintering systems 20 and the conveyer unit 10 simultaneously. The continuous production vacuum sintering apparatus can be further equipped with an uninterrupted power system (not shown); the uninterrupted power system is capable of supplying power when the external power source is cut off unexpectedly to avoid huge damage and cost.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A continuous production vacuum sintering apparatus, comprising:

a conveyer unit; and a plurality of vacuum sintering systems individually transferred by the conveyer unit, each of the vacuum sintering systems including a sintering furnace, a vacuum control unit and a temperature control unit electrically connecting the sintering furnace;

wherein the respective vacuum sintering systems correspond to a plurality of sintering steps, each continuing from a previous one with a predetermined period, the vacuum sintering systems are separate from one another, and respective pressure and temperature conditions provided by corresponding vacuum sintering systems do not interfere with one another.

2. The continuous production vacuum sintering apparatus as claimed in claim 1, wherein the predetermined period is about 60 seconds.

3. The continuous production vacuum sintering apparatus as claimed in claim 1, wherein the vacuum control unit includes a diffusion pump, an oil pump and a vacuum valve.

4. The continuous production vacuum sintering apparatus as claimed in claim 3, wherein a quantity of the vacuum sintering systems is at least six.

5. The continuous production vacuum sintering apparatus as claimed in claim 4, wherein one of the vacuum sintering systems has conditions approaching normal pressure and normal temperature.

6. The continuous production vacuum sintering apparatus as claimed in claim 4, wherein one of the vacuum sintering systems has a pressure condition ranging from a normal pressure to a first pressure approaching 1 Torr via the oil pump, and a temperature condition ranging from a normal temperature to a first temperature approaching 350 degrees centigrade.

7. The continuous production vacuum sintering apparatus as claimed in claim 4, wherein one of the vacuum sintering systems has a pressure condition ranging from a first pressure approaching $10^{-2}$ Torr to a second pressure approaching $10^{-5}$ Torr via the diffusion pump, and a temperature condition ranging from a first temperature approaching 350 degrees centigrade to a second temperature approaching 380 degrees centigrade.

8. The continuous production vacuum sintering apparatus as claimed in claim 4, wherein one of the vacuum sintering systems has a pressure condition of a second pressure approaching $10^{-5}$ Torr and a temperature condition of a second temperature approaching 380 degrees centigrade.

9. The continuous production vacuum sintering apparatus as claimed in claim 4, wherein one of the vacuum sintering systems has a pressure condition of a second pressure approaching $10^{-5}$ Torr, and a temperature condition ranging from a second temperature approaching 380 degrees centigrade to a third temperature approaching 50 degrees centigrade.

10. The continuous production vacuum sintering apparatus as claimed in claim 4, wherein one of the vacuum sintering systems has a pressure condition ranging from a second pressure approaching $10^{-5}$ Torr to a third pressure approaching $10^{-2}$ Torr via the diffusion pump, and a temperature condition ranging from a third temperature approaching 50 degrees centigrade to a normal temperature.

11. The continuous production vacuum sintering apparatus as claimed in claim 4, wherein one of the vacuum sintering systems has a pressure condition ranging from a second pressure approaching $10^{-2}$ Torr to approach to a normal pressure via the oil pump, and a temperature condition ranging from a third temperature approaching 50 degrees centigrade to a normal temperature, wherein the normal pressure is provided after the vacuum valve switches on.

12. The continuous production vacuum sintering apparatus as claimed in claim 1, further including a plurality of monitoring modules corresponding to the respective vacuum sintering systems.

13. The continuous production vacuum sintering apparatus as claimed in claim 12, wherein the monitoring modules communicate with the respective vacuum sintering systems and the conveyer unit in a remote manner.

14. The continuous production vacuum sintering apparatus as claimed in claim 12, wherein the monitoring modules electrically and mechanically connect the respective vacuum sintering systems and the conveyer unit simultaneously.

15. The continuous production vacuum sintering apparatus as claimed in claim 12, further including an emergency power interruption unit arranged thereto, the emergency power interruption unit is capable of shutting down the power when any unusual status is detected by each of the monitoring modules.

16. The continuous production vacuum sintering apparatus as claimed in claim 12, further including an uninterrupted power system, wherein the uninterrupted power system supplies power when the external power source is cut off unexpectedly.

17. The continuous production vacuum sintering apparatus as claimed in claim 1, wherein each of the vacuum sintering systems includes a glass coverplate enclosing the sintering furnace.

18. A vacuum sintering system adopted for a electron emission source, comprising:

a trolley;

a sintering furnace arranged above the trolley;

a glass coverplate enclosing the sintering furnace;

a vacuum control unit disposed on the trolley and communicating with the sintering furnace via an exhaustion valve;

a temperature control unit disposed in the sintering furnace and including an infrared radiation ceramic heater and a ceramic plate arranged above the infrared radiation ceramic heater, the ceramic plate being capable of spreading and transmitting heat from the infrared radiation ceramic heater, the electron emission source having a glass substrate contacting the ceramic plate, and the temperature control unit having a varying temperature with a predetermined rate; and a partition disposed in the sintering furnace and adjacent to the exhaustion valve.

19. The vacuum sintering system as claimed in claim 18, wherein the vacuum control unit includes a diffusion pump and an oil pump.

20. The vacuum sintering system as claimed in claim 19, wherein the oil pump provides a pressure condition approaching $10^{-2}$ Torr.

21. The vacuum sintering system as claimed in claim 20, wherein the diffusion pump provides a pressure condition approaching $10^{-5}$ Torr.

22. The vacuum sintering system as claimed in claim 18, further including a vacuum valve disposed in the sintering furnace to break the vacuum.

23. The vacuum sintering system as claimed in claim 22, wherein the vacuum valve communicates with an air supply to provide air that does not interfere with the electron emission source.

24. The vacuum sintering system as claimed in claim 23, wherein the air includes nitrogen or inert gases.

25. The vacuum sintering system as claimed in claim 18, wherein the predetermined rate approaches 10 degrees centigrade per second.

26. The vacuum sintering system as claimed in claim 18, wherein the temperature control unit provides a highest temperature ranging from about 370 to 390 degrees centigrade, and a preferred maximum temperature approaches about 380 degrees centigrade.

* * * * *